United States Patent [19]

Stahlecker

[11] 3,959,961

[45] June 1, 1976

[54] APPARATUS FOR REMOVING IMPURITIES FROM FIBROUS MATERIAL

[75] Inventor: Fritz Stahlecker, Bad Uberkingen, Germany

[73] Assignees: Fritz Stahlecker; Hans Stahlecker, both of Germany

[22] Filed: Oct. 25, 1974

[21] Appl. No.: 518,153

[30] Foreign Application Priority Data

Nov. 2, 1973 Germany ..... 2354967

[52] U.S. Cl. ..... 57/56; 57/58.95

[51] Int. Cl.[2] ..... D01H 11/00; D01H 1/12

[58] Field of Search ..... 57/56, 58.89–58.95, 57/34 R

[56] References Cited

UNITED STATES PATENTS

| | | | |
|---|---|---|---|
| 3,777,329 | 12/1973 | Lane | 57/58.89 X |
| 3,777,466 | 12/1973 | Kabele et al. | 57/56 |
| 3,792,575 | 2/1974 | Doublebsky et al. | 57/58.89 X |
| 3,797,218 | 3/1974 | Landwehrkamp | 57/56 X |
| 3,800,521 | 4/1974 | Doublebsky et al. | 57/58.95 |
| 3,834,145 | 9/1974 | Ellingham et al. | 57/56 |
| 3,859,779 | 1/1975 | Furstenberg | 57/58.89 |
| 3,884,027 | 5/1975 | Schumann et al. | 57/56 |

*Primary Examiner*—Donald E. Watkins
*Attorney, Agent, or Firm*—Craig & Antonelli

[57] ABSTRACT

Located in the path of transport for the fibres in an apparatus for supplying separated fibres to a spinning rotor of an open-end spinning unit is a removal opening, from which the impurities contained in the fibrous material are removed. In order to be able to provide mechanical conveying means, which do not disturb the pneumatic fibre transport, behind the removal opening and at a relatively great distance therefrom, the removal opening is designed in such a manner that it serves as a type of air buffer and impairs the formation of a strong air flow.

5 Claims, 3 Drawing Figures

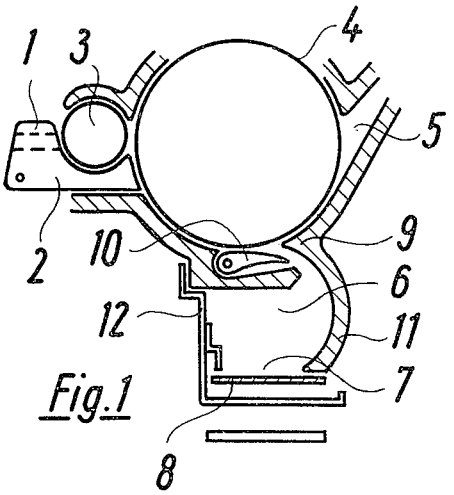
Fig.1
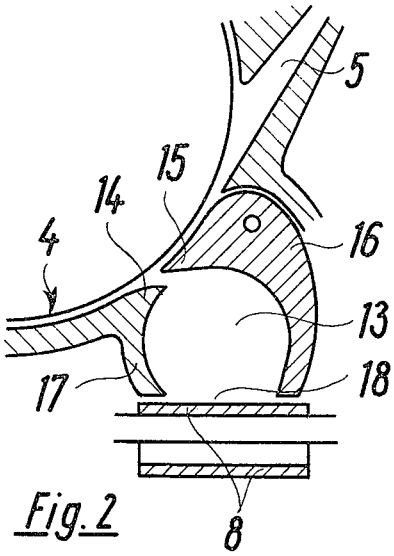
Fig.2
Fig.3
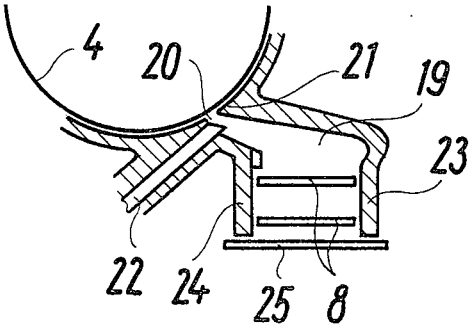

APPARATUS FOR REMOVING IMPURITIES FROM FIBROUS MATERIAL

The present invention relates to an apparatus for separating fibrous material supplied to a spinning rotor of an open-end spinning unit, having a path of travel for said separated fibres, in which is located an opening for removing impurities contained in said fibrous material, said opening having a wider area between its inlet and its outlet, and in which conveying means travel past said opening.

Apparatuses for removing impurities from fibrous material in which a removal opening is followed by mechanical conveying means have already been proposed. In apparatuses of this type, there is a certain degree of difficulty in eliminating, to the greatest possible extend, the penetration of infiltrated air through the mechanical conveying means so as to prevent disturbances of the fibre transport.

It is the object of the present invention to create an apparatus in which, with the aid of simple non-wearing sealing means, the penetration of infiltrated air is largely prevented. According to the present invention, there is an apparatus for separating fibrous material supplied to a spinning rotor of an open-end spinning unit, having a path of travel for said separated fibres, in which is located an opening for removing impurities contained in said fibrous material, said opening having a wider area between its inlet and its outlet, and in which conveying means travel past said opening.

This permits the removal opening itself to serve as a type of air buffer, which at least impairs the formation of an air flow as a type of labyrinth seal. It is therefore possible to arrange the mechanical conveying means at a relatively large distance from the defining walls of the removal opening, thereby eliminating wear through friction.

The above discussed and other objects, features and advantages of the present invention will become more apparent from the following description thereof, when taken in connection with the accompanying drawings, in which FIG. 1 shows a partial section through a separating apparatus of an open-end spinning unit having an apparatus according to the present invention for removing impurities;

FIG. 2 shows a partial section through a further embodiment, having a pivotal defining wall; and FIG. 3 shows a partial section through a further embodiment of the apparatus according to the present invention.

Referring now to the drawings, wherein like reference numerals designate like parts throughout the several views, an unillustrated sliver is supplied to the separating apparatus partially illustrated in FIG. 1 through a funnel 1 from a delivery cylinder 3 operating conjointly with a pivotal undercasing lever 2. Delivery cylinder 3 is followed by a separating roller 4, whose periphery has a serrated or similarly designed ripping means. Separating roller 4 travels at a much higher speed than delivery cylinder 3, so that the sliver is separated into its individual strands. The individual strands of the separated sliver are sucked through a channel 5 with an underpressure to an unillustrated spinning rotor, in which a thread is spun.

Arranged in the area of the path of travel of the separated fibres, and preferably in the area of the periphery of separating roller 4, is an apparatus for removing impurities from the fibrous material. This apparatus consists primarily of a removal opening 6, whose outlet 7 is followed by mechanical conveying means, which pick up the impurities and transport them away. In the illustrated embodiment, a conveyor belt 8 serves as a mechanical conveying means, said conveyor belt 8 extending longitudinally along the machine and picking up and transporting away the impurities from a plurality, and preferably all, of the spinning points of a side of the machine. The entrance to removal opening 6 is formed by a removal edge 9 and a pivotal flap 10. Through the pivotal flap 10, the size of the entrance can be altered from a completely closed position to a maximum value.

The removal opening 6, illustrated as a widened area between inlet 9, 10 and outlet 7, is defined by wall members 11 and 12, of which at least wall member 12 is designed as a removable piece of sheet metal.

As a result of centrifugal force, the impurities which are heavier than the fibres, are spun out and removed by removal edge 9. Wall member 11 adjacent to removal edge 9 is designed as a curved sliding surface, leading to conveyor belt 8.

In the embodiment shown in FIG. 1, there are sealing gaps between outlet 7 of removal opening 6 and conveyor belt 8 located thereunder, which can be kept relatively large without an excessive danger of penetration of infiltrated air. This is achieved in that a removal opening 6 having a widened area acts as an air buffer, which at least greatly impairs the formation of a strong flow between the gaps between conveyor belt 8 and the wall members adjacent thereto.

In the embodiment according to FIG. 2, removal opening 13 has a generally cylindrical widened area, whose axis extends parallel to the axis of separating roller 4. In this embodiment, the inlet of removal opening 13 is formed by a stationary housing edge 14 and a movable removal edge 15. Removal edge 15 is a part of a wall member 16, which leads, with a generally cylindrically curved guiding surface, to the mechanical conveying means located therebeneath, conveyor belt 8. The lower edges of wall member 16 and a wall member 17 form an outlet 18 above belt 8, said outlet 18 being smaller than the widened area, however having a larger cross section than inlet 14, 15.

In the embodiment according to FIG. 3, the removal opening located in the area of the periphery of a separating roller 4 is designed in the form of a channel. Its inlet 20 is formed by a removal edge 21 and an adjustable slide 22. Wall members 23 and 24 of removal opening 19, which first extend at an incline relative to separating roller 4, first widen in a wedge-shaped manner and are then angled downward. Wall member 23 guides the impurities to conveyor belt 8. The lower ends of wall members 23 and 24 are closed with means 25, so that there are only air gaps at the side areas through which the infiltrated air can penetrate. In this embodiment, also, a widening of the area of the removal opening 19 creates a design having a sealing function.

Conveyor belt 8, which preferably travels past the separating rollers of all spinning points of a side of the machine, has, in a manner which is not illustrated in more detail, discharge means for the impurities which provide further transport of the impurities away from the machine. It is practical to provide cleaning means operating with brushes or similar means in the area of these discharge means to also free conveyor belt 8 of sticking impurities.

Obviously, many modifications and variations of the present invention are possible in the light of the above teachings. It should therefore be understood that within the scope of the appended claims, the invention may be practiced otherwise than as specifically described.

Having thus fully disclosed my invention, what I claim is:

1. An apparatus for separating fibrous material supplied to a spinning rotor of an open-end spinning unit, having a path of travel for said separated fibers, in which is located an opening for removing impurities contained in said fibrous material, said opening having a wider area between its inlet and its outlet, and in which a conveying belt means travel past the outlet of said opening for carrying away the impurities.

2. The apparatus according to claim 1, in which the outlet of said removal opening has a significantly larger cross section than the inlet.

3. The apparatus according to claim 1, in which said outlet is vertically staggered relative to the inlet of the removal opening.

4. The apparatus according to claim 2, in which the outlet is vertically staggered relative to the smaller inlet of the removal opening.

5. The apparatus according to claim 1, in which at least one wall surface of the wider area of said removal opening is designed as a guiding surface directing toward said conveying means.

* * * * *